US005957011A

United States Patent [19]

Thompson

[11] Patent Number: 5,957,011

[45] Date of Patent: Sep. 28, 1999

[54] FOUR WHEEL DRIVE LOCKING HUB TOOL

[76] Inventor: John H. Thompson, 11749 Kenyon Rd., Mt. Vernon, Ohio 43050

[21] Appl. No.: 08/897,901

[22] Filed: Jul. 21, 1997

[51] Int. Cl.[6] ..... B25B 13/48

[52] U.S. Cl. ..... 81/176.15; 81/461

[58] Field of Search ..... 81/176.1–176.3, 81/119, 15.9, 6, 461, 3.05, 8.1; D8/27

[56] References Cited

U.S. PATENT DOCUMENTS

| | | | |
|---|---|---|---|
| 541,651 | 6/1895 | Baumgartner | 81/176.15 X |
| 971,672 | 10/1910 | Gibson et al. | 81/461 X |
| 2,383,573 | 8/1945 | Tomsek | 81/176.15 X |
| 4,252,036 | 2/1981 | Vanderhoof | 81/461 |
| 5,154,102 | 10/1992 | Becker | 81/176.15 X |
| 5,365,808 | 11/1994 | Palmer | 81/176.15 X |

FOREIGN PATENT DOCUMENTS

| | | | |
|---|---|---|---|
| 556 145 | 9/1943 | United Kingdom | 81/461 |

*Primary Examiner*—D. S. Meislin

[57] ABSTRACT

A new four wheel drive locking hub tool for locking unlocking manual wheel hubs of four wheel drive vehicles. The inventive device includes a handle portion having a T-shaped configuration. The handle portion includes a horizontal segment and a vertical segment with the vertical segment extending outwardly from the horizontal segment in an orthogonal relationship. A base portion is provided having a rectangular configuration. An upper surface of the base portion is integrally formed with a free end of the vertical segment of the handle portion. A mating portion extends downwardly from the base portion and dimensioned for engaging a recessed locking hub of a wheel.

3 Claims, 2 Drawing Sheets

FOUR WHEEL DRIVE LOCKING HUB TOOL

BACKGROUND OF THE INVENTION

1. Field of the Invention

The present invention relates to wheel cover locks and more particularly pertains to a new four wheel drive locking hub tool for locking and unlocking manual wheel hubs of four wheel drive vehicles.

2. Description of the Prior Art

The use of wheel cover locks is known in the prior art. More specifically, wheel cover locks heretofore devised and utilized are known to consist basically of familiar, expected and obvious structural configurations, notwithstanding the myriad of designs encompassed by the crowded prior art which have been developed for the fulfillment of countless objectives and requirements.

Known prior art wheel cover locks include U.S. Pat. No. 4,061,058 to Douglas; U.S. Pat. No. 4,569,259 to Rubion et al.; U.S. Pat. No. Des. 357,617 to Morrissette; U.S. Pat. No. 4,252,036 to Vanderhoof; U.S. Pat. No. 4,125,913 to Lewis; and U.S. Pat. No. 4,100,663 to Crum.

While these devices fulfill their respective, particular objectives and requirements, the aforementioned patents do not disclose a new four wheel drive locking hub tool. The inventive device includes a handle portion having a T-shaped configuration. The handle portion includes a horizontal segment and a vertical segment with the vertical segment extending outwardly from the horizontal segment in an orthogonal relationship. A base portion is provided having a rectangular configuration. An upper surface of the base portion is integrally formed with a free end of the vertical segment of the handle portion. A mating portion extends downwardly from the base portion and dimensioned for engaging a recessed locking hub of a wheel.

In these respects, the four wheel drive locking hub tool according to the present invention substantially departs from the conventional concepts and designs of the prior art, and in so doing provides an apparatus primarily developed for the purpose of locking and unlocking manual wheel hubs of four wheel drive vehicles.

SUMMARY OF THE INVENTION

In view of the foregoing disadvantages inherent in the known types of wheel cover locks now present in the prior art, the present invention provides a new four wheel drive locking hub tool construction wherein the same can be utilized for locking and unlocking manual wheel hubs of four wheel drive vehicles.

The general purpose of the present invention, which will be described subsequently in greater detail, is to provide a new four wheel drive locking hub tool apparatus and method which has many of the advantages of the wheel cover locks mentioned heretofore and many novel features that result in a new four wheel drive locking hub tool which is not anticipated, rendered obvious, suggested, or even implied by any of the prior art wheel cover locks, either alone or in any combination thereof.

To attain this, the present invention generally comprises a handle portion having a T-shaped configuration. The handle portion includes a horizontal segment and a vertical segment with the vertical segment extending outwardly from the horizontal segment in an orthogonal relationship. A base portion is provided having a rectangular configuration. An upper surface of the base portion is integrally formed with a free end of the vertical segment of the handle portion. A mating portion is dimensioned for engaging a recessed locking hub of a wheel. The mating portion comprises a pair of semi-circular projections extending downwardly from a lower surface of the base portion. The pair of semi-circular projections each have a planar interior surface, a planar exterior surface and opposed arcuate side surfaces. The pair of semi-circular projections have a space disposed between the planar interior surfaces thereof. The pair of semi-circular projections are dimensioned for engaging recesses of the recessed locking hub of the wheel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new four wheel drive locking hub tool apparatus and method which has many of the advantages of the wheel cover locks mentioned heretofore and many novel features that result in a new four wheel drive locking hub tool which is not anticipated, rendered obvious, suggested, or even implied by any of the prior art wheel cover locks, either alone or in any combination thereof.

It is another object of the present invention to provide a new four wheel drive locking hub tool which may be easily and efficiently manufactured and marketed.

It is a further object of the present invention to provide a new four wheel drive locking hub tool which is of a durable and reliable construction.

An even further object of the present invention is to provide a new four wheel drive locking hub tool which is susceptible of a low cost of manufacture with regard to both materials and labor, and which accordingly is then susceptible of low prices of sale to the consuming public, thereby making such four wheel drive locking hub tool economically available to the buying public.

Still yet another object of the present invention is to provide a new four wheel drive locking hub tool which provides in the apparatuses and methods of the prior art some of the advantages thereof, while simultaneously overcoming some of the disadvantages normally associated therewith.

Still another object of the present invention is to provide a new four wheel drive locking hub tool for locking and unlocking manual wheel hubs of four wheel drive vehicles.

Yet another object of the present invention is to provide a new four wheel drive locking hub tool which includes a handle portion having a T-shaped configuration. The handle portion includes a horizontal segment and a vertical segment with the vertical segment extending outwardly from the horizontal segment in an orthogonal relationship. A base portion is provided having a rectangular configuration. An upper surface of the base portion is integrally formed with a free end of the vertical segment of the handle portion. A mating portion extends downwardly from the base portion and dimensioned for engaging a recessed locking hub of a wheel.

Still yet another object of the present invention is to provide a new four wheel drive locking hub tool that will save a driver time and effort when ordinarily having to make manual adjustments for different driving conditions.

Even still another object of the present invention is to provide a new four wheel drive locking hub tool that eliminates the need for hand-made adjustments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
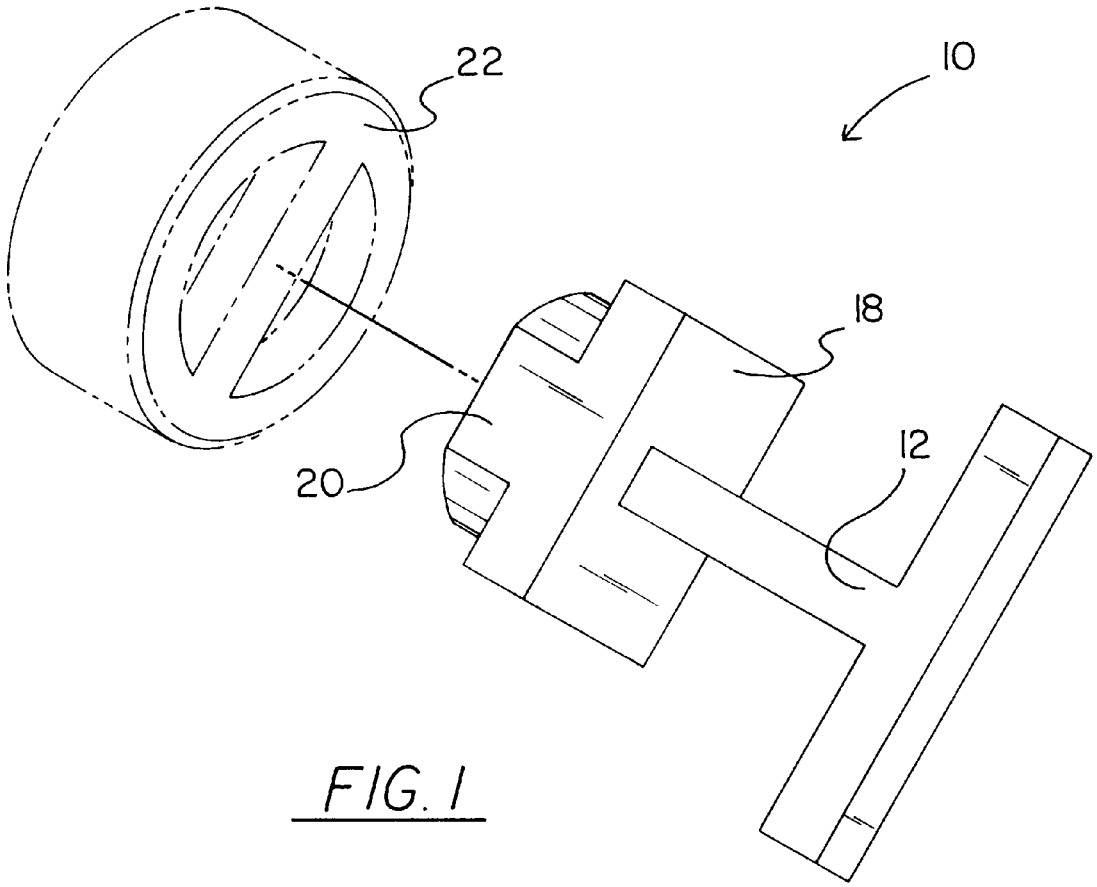
FIG. 1 is a perspective view of a new four wheel drive locking hub tool according to the present invention.
Figure 2:
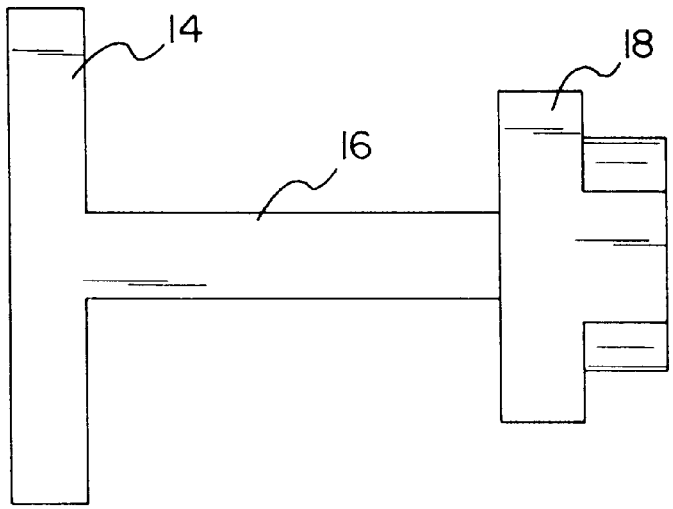
FIG. 2 is a top plan view of the present invention.
Figure 3:
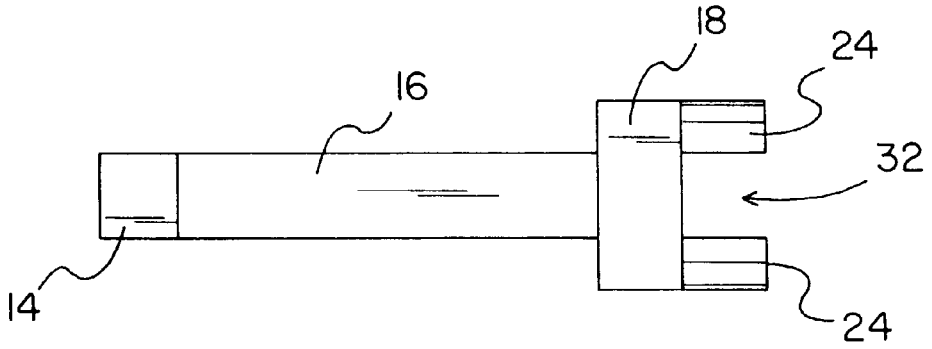
FIG. 3 is a side elevation view of the present invention.
Figure 4:
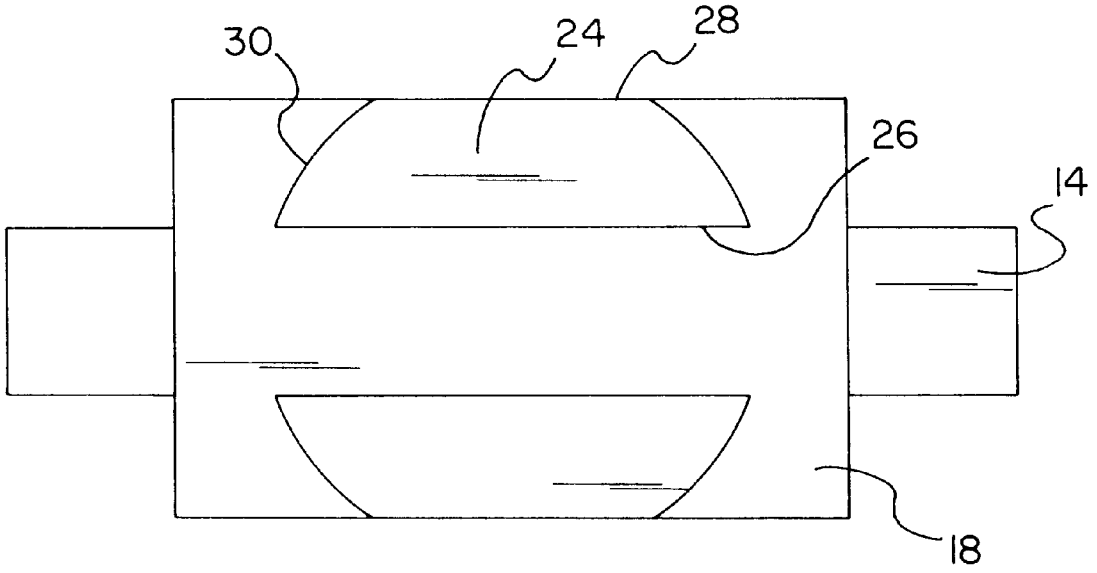
FIG. 4 is a front elevation view of the present invention.

With reference now to the drawings, and in particular to FIGS. 1 through 4 thereof, a new four wheel drive locking hub tool embodying the principles and concepts of the present invention and generally designated by the reference numeral 10 will be described.

As best illustrated in FIGS. 1 through 4, the four wheel drive locking hub tool 10 comprises a handle portion 12 having a T-shaped configuration. The handle portion 12 includes a horizontal segment 14 and a vertical segment 16 with the vertical segment 16 extending outwardly from the horizontal segment 14 in an orthogonal relationship. The handle portion 12 is preferably constructed of a rigid plastic or stainless steel and has a length of about three inches to allow for torque to be transmitted.

A base portion 18 is provided having a rectangular configuration. An upper surface of the base portion 18 is integrally formed with a free end of the vertical segment 16 of the handle portion 12.

A mating portion 20 is dimensioned for engaging a recessed locking hub 22 of a wheel. The mating portion 20 comprises a pair of semi-circular projections 24 extending downwardly from a lower surface of the base portion 18. The pair of semi-circular projections 24 each have a planar interior surface 26, a planar exterior surface 28 and opposed arcuate side surfaces 30. The pair of semi-circular projections 24 have a space 32 disposed between the planar interior surfaces 26 thereof. The pair of semi-circular projections 24 are dimensioned for engaging recesses of the recessed locking hub 22 of the wheel.

In use, when a driver wants to adjust the locking hubs 22, the device 10 would be retrieved and carried to the front side of the car. With the pair of semi-circular projections 24 inserted and engaged in the center wheel hub 22, torque can be applied to the handle portion 12. This would quickly turn the hub 22 to the desired position. The process could be repeated on the opposite front side of the truck.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A four wheel drive locking hub system for locking and unlocking manual wheel hubs of four wheel drive vehicles, the system comprising, in combination:

a locking hub of a wheel having an outer face with a pair of semi-circular recesses separated by a gripping rib for being gripped by the fingers of a user, each of the semi-circular recesses having a perimeter with a straight portion adjacent to the gripping rib and an arcuate portion adjacent to an outer periphery of the outer face;

a locking hub tool comprising:

a base portion having a substantially rectangular configuration, said base portion having an upper surface and a lower surface;

a handle portion having a T-shaped configuration, the handle portion including a first segment and a second segment with the second segment having a longitudinal axis extending substantially perpendicularly outwardly from the upper surface of the base portion, the first segment being mounted to the second segment in a substantially orthogonal relationship, the first segment of the handle portion having a length greater than a length of a longest side of the substantially rectangular base portion; and a mating portion dimensioned for engaging the recesses of the locking hub of the wheel, the mating portion comprising a pair of semi-circular projections mounted on the lower surface of the base portion, the pair of semi-circular projections each having a planar interior surface, a planar exterior surface positioned parallel to the longitudinal axis of the second segment of the handle, and opposed substantially arcuate side surfaces extending between the interior surface and the exterior surface such that a length of the interior surface is greater than a length of the exterior surface, the pair of substantially semi-circular projections defining an elongate gap between the planar interior surfaces thereof adapted for receiving the gripping rib of the locking hub therebetween with the pair of substantially semi-circular projections projecting into the recesses of the locking hub of the wheel such that the planar interior surfaces each engage one of the straight portions of the locking hub;

wherein the elongate gap has a longitudinal axis substantially parallel to a longitudinal axis of the first segment of the handle portion; and wherein the lower surface of the base portion extends outwardly from the pair of substantially semi-circular projections for abutting against the outer face of the locking hub.

2. A four wheel drive locking hub tool for locking and unlocking manual wheel hubs of four wheel drive vehicles, the manual wheel hubs each being of the type having a locking hub on a wheel with an outer face with a pair of semi-circular recesses separated by a gripping rib, each of the semi-circular recesses having a perimeter with a straight portion adjacent to the gripping rib and an arcuate portion adjacent to an outer periphery of the outer face, the locking hub tool comprising:

a base portion having a substantially rectangular configuration, said base portion having an upper surface and a lower surface;

a handle portion having a T-shaped configuration, the handle portion including a first segment and a second segment with the second segment extending substantially perpendicularly outwardly from the upper surface of the base portion, the second segment being united to the first segment in a substantially orthogonal relationship; and a mating portion mounted on the lower face of the base portion and dimensioned for engaging the recesses of the locking hub of a wheel, the mating portion comprising a pair of semi-circular projections mounted on the lower surface of the base portion, the pair of semi-circular projections each having a planar interior surface, a planar exterior surface positioned parallel to the longitudinal axis of the horizontal segment of the handle, and opposed substantially arcuate side surfaces extending between the interior surface and the exterior surface such that a length of the interior surface is greater than a length of the exterior surface, the pair of substantially semi-circular projections defining an elongate gap between the planar interior surfaces thereof adapted for receiving the gripping rib of the locking hub therebetween with the pair of substantially semi-circular projections projecting into the recesses of the locking hub of the wheel such that the planar interior surfaces are each adapted for engaging one of the straight portions of the locking hub;

wherein the elongate gap has a longitudinal axis substantially parallel to a longitudinal axis of the first segment of the handle portion; and wherein the lower surface of the base portion extends outwardly from the pair of substantially semi-circular projections for abutting against the outer face of the locking hub.

3. The four wheel drive locking hub tool as set forth in claim 2 wherein the first segment of the handle portion has a length greater than a length of a longest side of the substantially rectangular base portion.

* * * * *